United States Patent [19]

Hirasawa

[11] 4,060,063

[45] Nov. 29, 1977

[54] THROTTLE POSITIONER

[75] Inventor: Koichi Hirasawa, Toyota, Japan

[73] Assignee: Toyota Jidosha Kogyo Kabushiki Kaisha, Toyota, Japan

[21] Appl. No.: 604,209

[22] Filed: Aug. 13, 1975

[30] Foreign Application Priority Data

June 2, 1975 Japan ..... 50-74612[U]
June 2, 1975 Japan ..... 50-74613[U]

[51] Int. Cl.[2] ..... F02D 31/00

[52] U.S. Cl. ..... 123/97 B; 123/97 R; 123/103 R; 123/198 DB; 261/DIG. 19

[58] Field of Search ..... 123/103 R, 97 B, 97 R, 123/122 D, 198 DB; 261/DIG. 19, 55

[56] References Cited

U.S. PATENT DOCUMENTS

| | | | |
|---|---|---|---|
| 3,547,089 | 12/1970 | Pielot | 161/DIG. 19 |
| 3,596,642 | 8/1971 | Nakata | 123/97 B |
| 3,744,471 | 7/1973 | Braun | 123/198 DB |
| 3,918,421 | 11/1975 | Berry | 123/122 D |

*Primary Examiner*—Ronald H. Lazarus
*Attorney, Agent, or Firm*—Birch, Stewart, Kolasch & Birch

[57] ABSTRACT

A throttle positioner having a structure that a lever drivingly connected to a rotary shaft of a throttle valve is positively driven in a throttle opening direction by a lever driving element which is driven in said direction by a diaphragm means to establish a throttle positioner pre-set opening when the throttle positioner is to be actuated.

9 Claims, 2 Drawing Figures

THROTTLE POSITIONER

BACKGROUND OF THE INVENTION

1. Field of the Invention

The present invention relates to a throttle positioner for use with a carburetor of an internal combustion engine and, more particularly, a novel structure of the throttle positioner which obviates some inherent drawbacks in the conventional throttle positioner.

2. Description of the Prior Art

When an automobile is decelerated while it is running, the amount of uncombusted components in the exhaust gas significantly increases. In order to solve this problem, a device which is called a throttle positioner has been proposed. The throttle positioner operates to hold a throttle valve at a predetermined opening position where it is slightly opened from its idling position when an automobile is decelerated, thereby maintaining a predetermined minimum amount of air supply through an intake manifold, thus avoiding heavy emission of uncombusted material in the exhaust gas.

Conventionally, the throttle positioner comprises a diaphragm means, a throttle positioning lever adapted to be driven by said diaphragm means so as to rotate between first and second rotary positions, and a throttle driving lever mounted on a rotary shaft of a throttle valve and adapted to engage a tip of said throttle positioning lever so as to hold return of the throttle valve at a predetermined opening position when said throttle positioning lever is in said first rotary position while disengaging from said tip of said throttle positioning lever so as to permit full return of the throttle valve to an idling position when said throttle positioning lever is in said second rotary position. The diaphragm means is adapted to be selectively supplied with atmospheric pressure or vacuum thereby rotating said throttle positioning lever to said first or second rotary position in order to selectively effect the operation of the throttle positioner when required. Manifold vacuum is generally employed as the vacuum to be selectively supplied to the diaphragm means. The manifold vacuum is taken out from a vacuum port provided at a position where the mnifold vacuum always exists. The vacuum thus obtained is selectively supplied to the diaphragm means under the control of an electro-magnetic valve adapted to operate according to the running condition of the automobile. Or alternatively, the manifold vacuum is taken out from a vacuum port which opens close to a tip end portion of a throttle valve rotated at its fully closed position, the vacuum taken out from the port being supplied to the diaphragm means without interposition of an electro-magnetic valve but generally with interposition of means to delay transmission of the vacuum. In the latter constitution, when the throttle valve is substantially opened, the vacuum port is located upstream of the throttle valve and, therefore, the port is not applied with any substantial manifold vacuum. In this condition, therefore, the diaphragm means is released thereby rotating the throttle positioning lever toward said first rotary position. If the throttle valve is rapidly closed in this condition, the throttle driving lever engages the throttle positioning lever thereby positioning the throttle valve at a throttle positioner pre-set opening. When the throttle valve is thus positioned at the throttle positioner pre-set opening, the vacuum port is located downstream of the throttle valve, whereby the port is applied with a substantial manifold vacuum, said vacuum being gradually supplied to the diaphragm means through said vacuum delay means. Therefore, the diaphragm means is gradually tightened to rotate the throttle positioning lever towards said second rotary position and, after the lapse of a predetermined time, the throttle driving lever is released from the engagement with the throttle positioning lever and the throttle valve is permitted to return to its idling position.

In the conventional throttle positioner, however, in order to accomplish the operation that the throttle driving lever is engaged by the throttle positioning lever to effect the throttle positioning action, the throttle driving lever must approach the throttle positioning lever rotated at its first rotary position from a distant position or, in other words, from a position where the throttle valve is substantially opened. This condition does not cause any problem when the throttle valve is rapidly returned toward its closing position from its substantially opened position as in the case where an automobile is decelerated from its normal running condition because, in this case, the throttle positioning lever certainly approaches the tip end of the throttle positioning lever rotated at its first rotary position. However, when the throttle positioner is utilized, in addition to its original object of preventing emission of a large amount of uncombusted components into the exhaust gas in a decelerating operation, to increase the output of the engine in its idling operation for the purpose of ensuring stable idling operation when an air conditioner is driven by the engine in the summer season, there occurs an inconvenience in that after the manifold vacuum has been supplied to the diaphragm means, by for example, switching-over of an electro-magnetic valve, the accelerating pedal must be stepped on so that the throttle driving lever is once removed from interference with the throttle positioning lever thereby permitting the throttle positioning lever to return to its first rotary position before the effective throttle positioning engagement between the throttle positioning lever and the throttle driving lever is obtained.

SUMMARY OF THE INVENTION

Therefore, it is the primary object of the present invention to solve the abovementioned drawback in the conventional throttle positioner and to provide an improved throttle positioner which is able to effect the throttle positioning action, instantly when required regardless of the rotary position of the throttle positioning lever.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

According to the present invention, the abovementioned object is accomplished by a throttle positioner comprising a lever drivingly connected to a rotary shaft of a throttle valve, a lever driving element adapted to contact and drive said lever in a direction to open said throttle valve, a diaphragm means drivingly connected to said lever driving element so as to drive said element in a first direction to ensure that said throttle valve is opened at least to a throttle positioner pre-set opening when vacuum is applied thereto and release said element in a second direction opposite to said first direction when vacuum is not applied thereto, and an electro-magnetic valve which selectively supplies atmospheric pressure or manifold vacuum to said diaphragm means.

In the abovementioned structure that the lever drivingly connected to a rotary shaft of the throttle valve is positively driven in the direction to open the throttle valve by the diaphragm means via said lever driving element, the throttle positioning action to set the throttle valve at the throttle positioner pre-set opening which is slightly opened from the idling position is directly accomplished by the diaphragm means being supplied with the manifold vacuum regardless of the rotary position of the throttle valve or the throttle driving lever.

According to an additional feature of the present invention, a conduit means which connects said diaphragm means and said electro-magnetic valve may advantageously be providied with a vacuum delay valve adapted to present substantially zero flow resistance to fluid which flows from said diaphragm means toward said electro-magnetic valve and a substantial flow resistance to fluid which flows in the opposite direction.

In the conventional throttle positioner, since the throttle valve held at the throttle positioner pre-set opening by the engagement of the throttle driving lever and the throttle positioning lever is abruptly released to return to its idling position after the lapse of a predetermined time, discomfort is usually suffered by the driver and, furthermore, a relatively large amount of HC is discharged in the exhaust gas for a period starting from the instant when the throttle valve is abruptly closed. By the provision of the abovementioned vacuum delay valve in the conduit means which supplies atmospheric pressure or manifold vacuum to the diaphragm means under the control of the electromagnetic valve, the releasing action of the lever driving element is always performed in a required gradual manner so that the driver feels no discomfort and the abnormal emission of HC is effectively avoided.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

Figure 1:
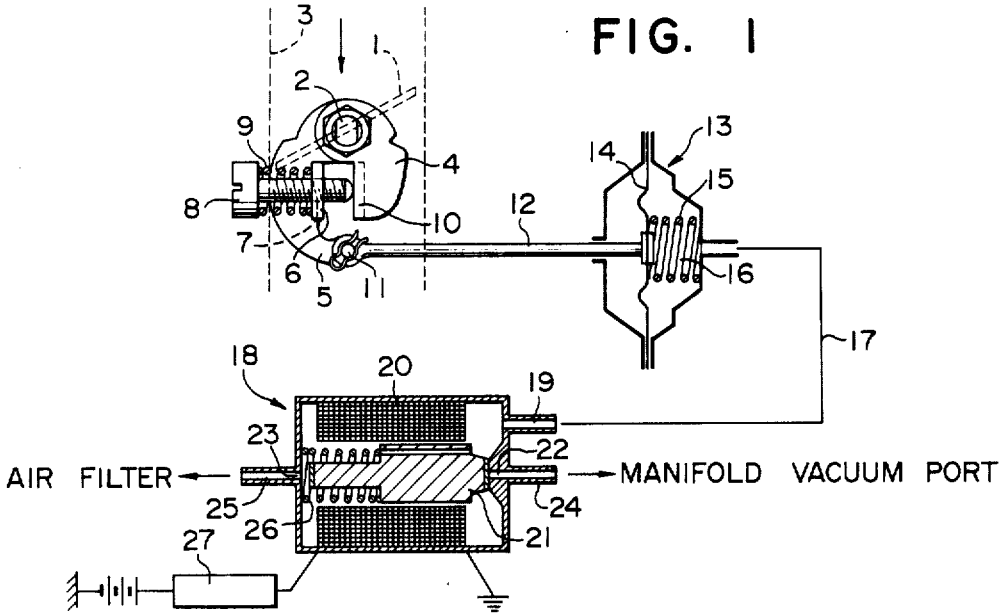
FIG. 1 is a diagrammatical view showing a basic embodiment of the throttle positioner according to the present invention; and, FIG. 2 is a diagrammatical view similar to FIG. 1 showing a modification of the throttle positioner according to the present invention.

Referring to FIG. 1, 1 designates a throttle valve which is supported by a rotary shaft 2 to be rotatable in an air intake passage 3 of a carburetor. A lever 4 is drivingly connected to the rotary shaft 2. The normal off-on operation of the throttle valve 1 is effected by a throttle valve control lever (not shown) which is also drivingly connected to the rotary shaft 2. In the shown embodiment, another lever 5 is mounted to the rotary shaft 2 to be freely rotatable with respect to the rotary shaft. The lever 5 is provided with a lug 6. In a threaded bore 7 formed in the lug is an adjusting screw 8 which is in engaging relationship therewith. A compression coil spring 9 is mounted around the screw 8, serving as a means to maintain an adjusted position of the screw 8. The tip end portion of the adjusting screw 8 is adapted to abut against a lug 10 formed at a portion of the lever 4.

An outer end of the lever 5 is pivotably connected to one end of a rod 12 by means of a pivot pin 11. The other end of the rod 12 is connected to a diaphragm 14 of a diaphragm means 13. The diaphragm 14 is applied with leftward spring force as seen in the figure by a compression coil spring 15 so that when vacuum is not supplied to a diaphragm chamber 16, the diaphragm is biased leftward at its loosened condition by the action of the compression coil spring. By contrast, when vacuum is applied to the diaphragm chamber 16, the diaphragm is tightened or moved rightward against the action of the compression coil spring 15.

The diaphragm chamber 16 of the diaphragm means 13 is connected through a conduit 17 to a port 19 of an electro-magnetic valve 18. The electro-magnetic valve comprises a solenoid 20 and a core 21 adapted to be driven by said solenoid. Opposite ends of the core 21 are formed as valve members which open or close valve ports 22 and 23 according to its axial displacement, thereby transmitting either manifold vacuum supplied from a conduit 24 or atmospheric pressure supplied from a conduit 25 to the port 19. The core 21 is constantly urged rightward in the figure by the compression coil spring 26 so as to close the port 22 and open the port 23. By contrast, when the solenoid 20 is energized, the core is moved leftward in the figure against the compression coil spring 26 so as to open the port 22 and close the port 23. The electric circuit for the solenoid 20 is controlled by a switch 27 which is turned on or off according to the operational condition of the automobile.

The system shown in FIG. 1 operates as follows:

When the throttle positioner need not operate or, in other words, the throttle valve may be returned to its fully closed position, the switch 27 is turned off. In this condition, the core 21 of the electro-magnetic valve 18 is urged rightward as shown in the figure by the compression coil spring 26 thereby closing the port 22 and opening the port 23. Therefore, the port 19 is supplied with atmospheric pressure, which is further supplied through the conduit 17 to the diaphragm chamber 16 of the diaphragm means 13. Therefore, the diaphragm 14 is urged leftward in the figure by the compression coil spring 15 or other return spring means incorporated in the throttle positioner (not shown) thereby turning the lever 5 clockwise around the rotary shaft 2 via the rod 12 so that the tip end of the adjusting screw 8 is retracted from the lug 10 of the lever 4. In this condition, the throttle valve 1 is permitted to rotate freely to its fully closed position. Thus, the throttle positioner is not actuated.

When the throttle positioner is to be actuated as in the condition where the automobile is suddenly decelerated while it is running or the air conditioner is put on in idling condition, the switch 27 is closed. Upon the closing of the switch, the solenoid 20 of the electro-magnetic valve 18 is energized, whereby the core 21 is moved leftward in the figure against the action of the compression coil spring 26 thereby opening the port 22 and closing the port 23. In this condition, the port 19 is supplied with manifold vacuum, which is then transmitted through the conduit 17 to the diaphragm chamber 16 of the diaphragm means 13. Therefore, the diaphragm 14 is biased rightward in the figure against the action of the compression coil spring 15 or aforementioned other return spring thereby turning the lever 5 counterclockwise around the rotary shaft 2 via the rod 12 so that the tip end of the adjusting screw 8 is advanced toward the lug 10 of the lever 4. In this condition, although the throttle valve 1 is driven at various rotary positions by the aforementioned throttle valve control lever (not shown), the closing rotation of the throttle valve beyond the throttle positioner pre-set opening is prevented by the lug 10 of the lever 4 being engaged with the tip end of the adjusting screw 8. In this connection, it will be appreciated that the throttle valve 1 is positively set at the throttle positioner pre-set opening when required regardless of the starting position of the throttle valve, by contrast to the conventional throttle positioner wherein the throttle valve must once be substantially opened before the throttle positioner is effectively actuated.

Figure 2:
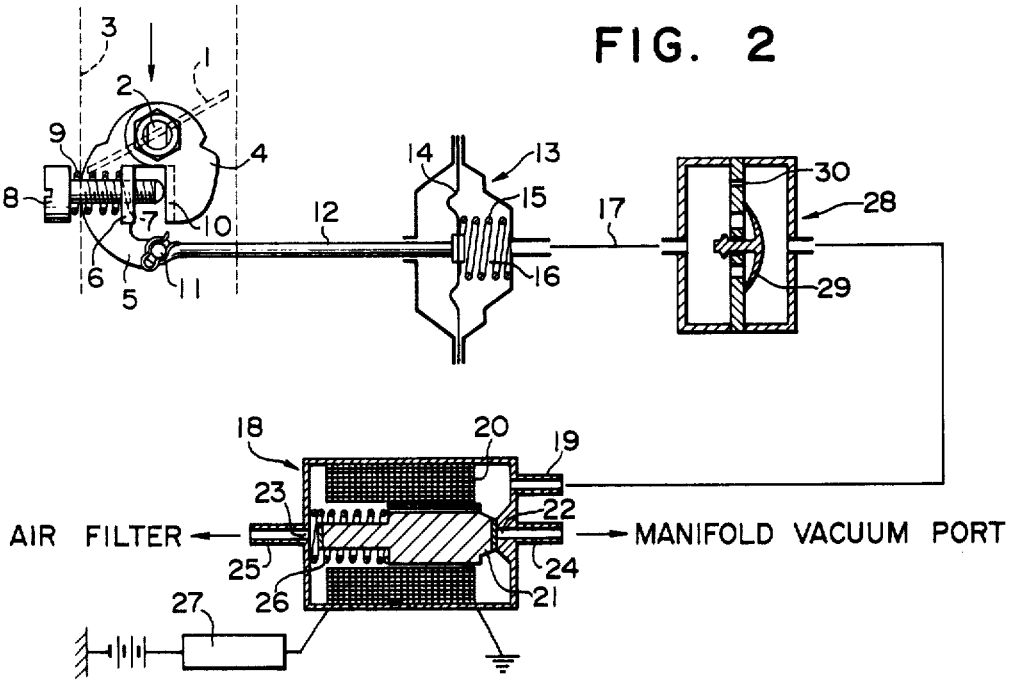

FIG. 2 is a diagrammatic view similar to FIG. 1 showing a modification of the throttle positioner shown in FIG. 1 and, accordingly, the portions corresponding to those shown in FIG. 1 are designated by the same reference numerals.

In the system shown in FIG. 2, a vacuum delay valve 28 is provided in the midst of the conduit 17. The vacuum delay valve 28 comprises a check valve 29 and a throttling orifice 30 arranged in parallel to each other. The check valve 29 is adapted to permit free flow of fluid from the diaphragm chamber 16 of the diaphragm means 13 toward the port 19 of the electro-magnetic valve 18 while preventing flow of fluid in the opposite direction. Therefore, when the manifold vacuum is supplied to the port 19 of the electro-magnetic valve upon the closing of the switch 27, the vacuum is swiftly transmitted to the diaphragm chamber 16 through the conduit 17 and the vacuum delay valve 28 provided in the midst of the conduit. By contrast, however, when the switch 27 is opened under the condition that the vacuum exists in the diaphragm chamber 16, the atmospheric pressure which is supplied to the port 19 of the electro-magnetic valve 18 is transmitted toward the diaphragm chamber 16 only through the throttling orifice 30 in the vacuum delay valve 28, whereby the vacuum existing in the diaphragm chamber 16 is gradually released in a certain lapse of time determined by the throttling rate of the orifice 30. Therefore, the action of the throttle positioner is gradually released thereby avoiding the drawbacks due to abrupt release of the throttle positioner such as the abnormal emission of uncombusted components and discomfort suffered by the driver.

Although the present invention has been illustrated and described with reference to some preferred embodiments, it will be apparent to those skilled in the art that various modifications of these embodiments can be made without departing from the spirit of the present invention.

I claim:

1. A throttle positioner for a throttle valve of an automobile engine having a rotary shaft, comprising:

a lever fixedly mounted on said rotary shaft;

a lever driving element mounted on said rotary shaft to be freely rotatable with respect to said shaft and adapted to drive said lever in a direction to open said throttle valve;

said lever and said lever driving element individually having lugs confronting each other;

said lug and said lever driving element supporting an adjusting screw threadably mounted thereto;

said adjusting screw having a tip end which drivingly abuts against said lug of said lever, whereby movement of said screw supported by said lever driving element in a first direction imparts motion of said lever;

a diaphragm means drivingly connected to said lever driving element so as to drive said lever in a first direction to ensure that said throttle valve is opened at least to a throttle positioner preset opening when a vacuum is applied thereto;

said lever driving element being adapted to release said lever in a second direction opposite to said first direction when atmospheric pressure is applied thereto;

passage means for supplying the manifold vacuum or atmospheric pressure to said diaphragm means;

an electro-magnetic valve which controls said passage means to selectively supply the manifold vacuum or atmospheric pressure through said passage means, and an electric circuit means for controlling said electro-magnetic valve in accordance with the operational conditions of the vehicle which incorporates the throttle positioner.

2. The throttle positioner of claim 1, wherein a vacuum delay valve is provided in said passage means, said vacuum delay valve being adapted to present substantially zero flow resistance to fluid which flows from said diaphragm means toward said electro-magnetic valve and a substantial flow resistance to fluid which flows in the opposite direction.

3. The throttle positioner of claim 1, wherein said lugs of said lever and lever driving element are provided to be substantially parallel with a phantom plane which includes the central axis of said rotary shaft when said lug of said lever engages said adjusting screw, said rod member extending substantially perpendicular to said phantom plane.

4. The throttle positioner of claim 3, wherein said rod member extends from its first end where it is pivotably connected with said lever driving element in a direction in which said lug of said lever driving element confronts said lug of said lever.

5. The throttle positioner of claim 2, wherein said vacuum delay valve comprises a check valve and a throttling orifice provided in parallel to each other.

6. The throttle positioner of claim 5, wherein said vacuum delay valve comprises a housing having a partition which devides said housing into two chambers, at least one valve opening provided in said partition, a flexible pad member mounted to said partition for covering said valve opening on one side of said partition in a manner so as to flexibly release said valve opening, and a throttle opening provided in said partition.

7. The throttle positioner of claim 1, wherein said electro-magnetic valve comprises a housing having axially aligned first and second ports and an additional third port, a core mounted in said housing to be axially movable between first and second positions, said core having first and second axial ends which cooperate respectively with said first and second ports so that when said core is located in said first position, said first port is closed while said second port is opened and when said core is located in said second position, said first port is opened while said second port is closed, a solenoid mounted in said housing adapted to drive said core toward said second position when energized, and a spring means which resiliently drives said core toward said first position.

8. The throttle positioner of claim 7, wherein said first and second ports are supplied with manifold vacuum and atmospheric pressure, respectively, while said third port is connected to said diaphragm means.

9. The throttle positioner of claim 1, wherein said diaphragm means comprises a diaphragm, a cup-like housing member supporting said diaphragm at its peripheral portion in a sealing manner thereby defining a diaphragm chamber on one side thereof and a rod member connected substantialy perpendicularly to said diaphragm at one end thereof, the other end of said rod member being pivotably connected with a free end portion of said lever driving element.

* * * * *